US012304609B2

(12) United States Patent
Groeschel et al.

(10) Patent No.: US 12,304,609 B2
(45) Date of Patent: May 20, 2025

(54) STERN DRIVES AND TRANSOM BRACKET ASSEMBLIES FOR STERN DRIVES PROVIDING VIBRATION ISOLATION

(71) Applicant: Brunswick Corporation, Mettawa, IL (US)

(72) Inventors: John A. Groeschel, Theresa, WI (US); Chetan Avinash Dharmadhikari, Brookfield, WI (US)

(73) Assignee: Brunswick Corporation, Mettawa, IL (US)

( * ) Notice: Subject to any disclaimer, the term of this patent is extended or adjusted under 35 U.S.C. 154(b) by 52 days.

(21) Appl. No.: 18/123,468

(22) Filed: Mar. 20, 2023

(65) Prior Publication Data

US 2023/0303231 A1 Sep. 28, 2023

Related U.S. Application Data

(60) Provisional application No. 63/324,251, filed on Mar. 28, 2022.

(51) Int. Cl.

| | |
|---|---|
| ***B63H 5/00*** | (2006.01) |
| ***B63H 21/14*** | (2006.01) |
| ***B63H 21/30*** | (2006.01) |

(52) U.S. Cl.

CPC ..... *B63H 21/305* (2013.01); *B63H 21/14* (2013.01)

(58) Field of Classification Search

CPC ..... B63H 21/305; B63H 21/14

See application file for complete search history.

(56) References Cited

U.S. PATENT DOCUMENTS

| | | | |
|---|---|---|---|
| 1,161,935 | A | 11/1915 | Heck |
| 1,774,956 | A | 9/1930 | Wilson |
| 2,372,247 | A | 3/1945 | Pemberton |
| 2,384,436 | A | 9/1945 | Bossen |
| 2,536,894 | A | 1/1951 | Wanzer |
| 2,549,481 | A | 4/1951 | Kiekhaefer |
| 2,688,299 | A | 9/1954 | Gload et al. |
| 2,732,819 | A | 1/1956 | Irgens |
| 2,804,838 | A | 9/1957 | Moser |

(Continued)

FOREIGN PATENT DOCUMENTS

| | | |
|---|---|---|
| CA | 1317165 | 5/1993 |
| CN | 101475050 | 7/2009 |

(Continued)

OTHER PUBLICATIONS

Extended European Search Report for EP 23164747.0 dated Aug. 30, 2023.

(Continued)

*Primary Examiner* — Amy J. Sterling

(74) *Attorney, Agent, or Firm* — Andrus Intellectual Property Law, LLP

(57) ABSTRACT

A stern drive for a marine vessel having a transom. The stern drive has a drive assembly comprising a drive unit configured to generate a thrust force in water and a powerhead configured to power the drive unit, and a transom bracket assembly configured to support the drive unit outside of the transom and further configured to support the powerhead inside of the transom, wherein the transom bracket assembly is configured to vibrationally isolate the drive unit and powerhead relative to the transom.

17 Claims, 7 Drawing Sheets

(56) References Cited

U.S. PATENT DOCUMENTS

| | | | | |
|---|---|---|---|---|
| 2,877,733 | A | 3/1959 | Harris | |
| 2,902,967 | A | 9/1959 | Wanzer | |
| 3,021,725 | A | 2/1962 | Schneider | |
| 3,084,657 | A | 4/1963 | Kiekhaefer | |
| 3,094,967 | A | 6/1963 | Willis | |
| 3,164,122 | A | 1/1965 | Morris | |
| 3,171,382 | A | 3/1965 | Bergstedt | |
| 3,285,221 | A | 11/1966 | North | |
| 3,310,021 | A | 3/1967 | Shimanckas | |
| 3,376,842 | A | 4/1968 | Wynne | |
| 3,404,586 | A | 10/1968 | Fanstone | |
| 3,483,843 | A | 12/1969 | Hawthorne | |
| 3,486,478 | A | 12/1969 | Halliday | |
| 3,548,775 | A | 12/1970 | Hammond et al. | |
| 3,707,939 | A | 1/1973 | Berg | |
| 3,738,306 | A | 6/1973 | Pinkerton | |
| 3,756,188 | A | 9/1973 | Smith | |
| 3,795,219 | A | 3/1974 | Peterson | |
| 3,841,257 | A | 10/1974 | Strang | |
| 3,881,443 | A | 5/1975 | Hump | |
| 3,896,757 | A | 7/1975 | Kucher | |
| 3,930,436 | A | 1/1976 | Hedenberg | |
| 3,946,698 | A | 3/1976 | LaFollette et al. | |
| 3,982,496 | A * | 9/1976 | Blanchard | B63H 5/07 440/52 |
| 4,276,034 | A | 6/1981 | Kashmerick | |
| 4,297,097 | A | 10/1981 | Kiekhaefer | |
| 4,323,354 | A | 4/1982 | Blanchard | |
| 4,343,612 | A | 8/1982 | Blanchard | |
| 4,371,348 | A | 2/1983 | Blanchard | |
| 4,418,633 | A | 12/1983 | Krautkremer et al. | |
| 4,432,737 | A | 2/1984 | Johansson | |
| 4,619,548 | A | 10/1986 | Kazaoka et al. | |
| 4,668,195 | A | 5/1987 | Smith | |
| 4,747,795 | A | 5/1988 | Kawamura et al. | |
| 4,887,982 | A | 12/1989 | Newman et al. | |
| 4,907,994 | A | 3/1990 | Jones | |
| 4,911,666 | A | 3/1990 | Gage et al. | |
| 4,932,907 | A | 6/1990 | Newman et al. | |
| 5,024,639 | A | 6/1991 | Crispo | |
| 5,108,325 | A | 4/1992 | Livingston et al. | |
| 5,112,256 | A | 5/1992 | Clement | |
| 5,224,888 | A | 7/1993 | Fujimoto et al. | |
| 5,280,708 | A | 1/1994 | Sougawa et al. | |
| 5,463,990 | A | 11/1995 | Rush, II et al. | |
| 5,465,633 | A | 11/1995 | Bernloehr et al. | |
| 5,480,330 | A | 1/1996 | Brown | |
| 5,487,687 | A | 1/1996 | Idzikowski et al. | |
| 5,522,744 | A | 6/1996 | Schlogel | |
| 5,540,606 | A | 7/1996 | Strayhorn | |
| 5,660,571 | A | 8/1997 | Nakayasu et al. | |
| 5,674,099 | A | 10/1997 | Muramatsu et al. | |
| 5,711,742 | A | 1/1998 | Leinonen et al. | |
| 5,743,774 | A | 4/1998 | Adachi et al. | |
| 6,146,220 | A | 11/2000 | Alby et al. | |
| 6,183,321 | B1 | 2/2001 | Alby et al. | |
| 6,273,771 | B1 | 8/2001 | Buckley et al. | |
| 6,276,977 | B1 | 8/2001 | Treinen et al. | |
| 6,286,845 | B1 | 9/2001 | Lin | |
| 6,287,159 | B1 | 9/2001 | Polakowski et al. | |
| 6,402,577 | B1 | 6/2002 | Treinen et al. | |
| 6,431,928 | B1 | 8/2002 | Aarnivuo | |
| 6,544,085 | B1 | 4/2003 | Menard et al. | |
| 6,554,083 | B1 | 4/2003 | Kerstetter | |
| 6,609,939 | B1 | 8/2003 | Towner et al. | |
| 7,163,427 | B1 | 1/2007 | Lee | |
| 7,244,152 | B1 | 7/2007 | Uppgard | |
| 7,267,587 | B2 | 9/2007 | Oguma et al. | |
| 7,290,638 | B2 | 11/2007 | Shiino et al. | |
| 7,347,753 | B1 | 3/2008 | Caldwell et al. | |
| 7,387,556 | B1 | 6/2008 | Davis | |
| 7,517,262 | B2 | 4/2009 | Mizutani | |
| 7,527,537 | B2 | 5/2009 | Mizutani | |
| 7,588,473 | B2 | 9/2009 | Beachy Head | |
| 7,641,527 | B1 | 1/2010 | Balaji et al. | |
| 7,662,005 | B2 | 2/2010 | Provost | |
| 7,699,674 | B1 | 4/2010 | Wald et al. | |
| 7,794,295 | B2 | 9/2010 | Beachy Head | |
| 7,871,302 | B2 | 1/2011 | Provost | |
| 7,886,678 | B2 | 2/2011 | Mizutani | |
| 7,896,304 | B1 | 3/2011 | Eichinger et al. | |
| 8,118,630 | B2 | 2/2012 | Konakawa et al. | |
| 8,118,701 | B2 | 2/2012 | Okabe et al. | |
| 8,142,247 | B2 | 3/2012 | Konakawa et al. | |
| 8,157,694 | B2 | 4/2012 | Nakamura et al. | |
| 8,246,398 | B2 | 8/2012 | Inaba | |
| 8,246,399 | B2 | 8/2012 | Inaba | |
| 8,327,789 | B2 | 12/2012 | Emch | |
| 8,425,373 | B2 | 4/2013 | Okabe et al. | |
| 8,485,854 | B2 | 7/2013 | Gallato et al. | |
| 8,651,904 | B2 | 2/2014 | Pellegrinetti et al. | |
| 8,690,616 | B2 | 4/2014 | Grassi et al. | |
| 8,715,021 | B2 | 5/2014 | Horkko et al. | |
| 8,795,011 | B2 | 8/2014 | Takase et al. | |
| 8,808,045 | B2 | 8/2014 | Lundqvist et al. | |
| 8,821,140 | B2 * | 9/2014 | Paval | F04C 15/0038 418/83 |
| 9,205,906 | B1 | 12/2015 | Eichinger | |
| 9,233,743 | B2 | 1/2016 | Daikoku et al. | |
| 9,296,458 | B2 | 3/2016 | Saruwatari et al. | |
| 9,334,034 | B1 | 5/2016 | Waldvogel et al. | |
| 9,446,828 | B1 * | 9/2016 | Groeschel | B63H 20/06 |
| 9,475,560 | B1 | 10/2016 | Jaszewski et al. | |
| 9,776,700 | B2 | 10/2017 | Beachy Head | |
| 9,809,289 | B2 | 11/2017 | Nutt et al. | |
| 9,849,957 | B1 | 12/2017 | Grahl et al. | |
| 9,896,175 | B2 | 2/2018 | Galletta, Jr. | |
| 10,215,278 | B1 | 2/2019 | Techscherer et al. | |
| 10,315,747 | B1 | 6/2019 | Jaszewski et al. | |
| 10,392,091 | B2 | 8/2019 | Galletta, Jr. | |
| 10,518,858 | B1 | 12/2019 | Klawitter et al. | |
| 10,752,328 | B1 | 8/2020 | Bielefeld et al. | |
| 10,800,502 | B1 | 10/2020 | Alby et al. | |
| 11,068,297 | B2 | 7/2021 | Galletta, Jr. | |
| 11,130,554 | B1 | 9/2021 | Alby et al. | |
| 11,292,568 | B2 | 4/2022 | Galletta, Jr. | |
| 2007/0004294 | A1 | 1/2007 | Mansfield et al. | |
| 2013/0045648 | A1 | 2/2013 | Kinpara et al. | |
| 2021/0339839 | A1 | 11/2021 | Galletta, Jr. | |

FOREIGN PATENT DOCUMENTS

| | | |
|---|---|---|
| GB | 364207 | 1/1932 |
| JP | 6004958 | 10/2016 |
| WO | WO 2007020906 | 2/2007 |
| WO | WO 2017223240 | 12/2017 |

OTHER PUBLICATIONS

NTN, Tri-Ball Joint, Constant Velocity Joints (Small and Medium size). CAT. No. 5602-V/E. Available online from URL: https://www.ntnglobal.com/en/products/catalog/en/5602/index.html.

NTN, Constant Velocity Joints for Industrial Machines: Application Examples. CAT.No.5604/E. Available online from URL: https://www.ntnglobal.com/en/products/catalog/en/5602/index.html.

NTN, Constant Velocity Joints for industrial machines. CAT. No. 5603-V/E. Available online from URL: https://www.ntnglobal.com/en/products/catalog/en/5602/index.html.

Extended European Search Report for European Patent Application No. 23 164754.6, dated Sep. 19, 2023.

* cited by examiner

STERN DRIVES AND TRANSOM BRACKET ASSEMBLIES FOR STERN DRIVES PROVIDING VIBRATION ISOLATION

CROSS REFERENCE TO RELATED APPLICATION

This application claims priority to U.S. Provisional Application No. 63/324,251, filed Mar. 28, 2022, which is incorporated herein by reference in its entirety.

FIELD

The present disclosure relates to marine drives, and in particular stern drives having a powerhead for propulsion, such as an engine and/or an electric motor.

BACKGROUND

The following U.S. Patents are incorporated herein by reference in entirety.

U.S. Pat. No. 6,287,159 discloses a support apparatus for a marine propulsion system in a marine vessel wherein a compliant member that is attachable to the transom of a marine vessel. In certain applications, the compliant member is directly attached to an intermediate plate and to an external frame member that is, in turn, attached directly to the transom of the marine vessel. The intermediate plate is attached directly to components of the marine propulsion system to provide support for the marine propulsion system relative to the transom, but while maintaining non-contact association between the marine propulsion system and the transom.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions.

U.S. Pat. No. 9,446,828 discloses an apparatus for mounting a marine drive to a hull of a marine vessel. An outer clamping plate faces an outside surface of the hull, and an inner clamping plate faces an opposing inside surface of the hull. A marine drive housing extends through the hull. The marine drive housing is held in place with respect to the hull by at least one vibration dampening sealing member which is disposed between the inner and outer clamping plates. A first connector clamps the outer clamping plate to the outside surface of the hull and a second connector clamps the inner clamping plate to the outer clamping plate. The inner and outer clamping plates are held at a fixed distance from each other so that a consistent compression force is applied to the vibration dampening sealing member.

SUMMARY

This Summary is provided to introduce a selection of concepts which are further described herein below in the Detailed Description. This Summary is not intended to identify key or essential features of the claimed subject matter, nor is it intended to be used as an aid in limiting the scope of the claimed subject matter.

In non-limiting examples disclosed herein, a stern drive is configured for a marine vessel having a transom. The stern drive includes a drive assembly comprising a drive unit configured to generate a thrust force in water, a powerhead configured to power the drive unit, and a transom bracket assembly configured to support the drive unit outside of the transom and further configured to support the powerhead inside of the transom, wherein the transom bracket assembly is configured to vibrationally isolate the drive unit and the powerhead relative to the transom.

Optionally, the powerhead may comprise an engine. Optionally, the transom bracket assembly may comprise a transom housing configured for positioning in an opening in the transom, and the transom housing may include an outer end coupled to the drive unit and an inner end coupled to the powerhead. Optionally, the transom bracket assembly may comprise an outer clamp bracket configured for attachment to an outside surface of the transom and an inner clamp bracket configured for attachment to an inside surface of the transom. Optionally, outer clamp bracket and the inner clamp bracket may be configured to be clamped together on the transom.

Optionally, the transom bracket assembly may comprise an outer vibration dampener which vibrationally isolates the drive unit and the powerhead relative to the outer clamp bracket. Optionally, the transom bracket assembly may comprise an inner vibration dampener which is separate from the outer vibration dampener and which vibrationally isolates the drive unit and the powerhead relative to the inner clamp bracket. Optionally, the inner vibration dampener may comprise a mount having an outer shell, a mounting hardpoint concentrically disposed in the outer shell, and an elastomeric spacer between the outer shell and the mounting hardpoint. Optionally, the inner vibration dampener may comprise a plurality of vibration dampening mounts spaced around the inner clamp bracket. Optionally, the outer vibration dampener may comprise a seal configured to prevent water intrusion to the marine vessel between the transom housing and the outer clamp bracket. Optionally, the seal may comprise a monolithic dual O-ring. Optionally, the transom bracket assembly may comprise a clamp plate which clamps the seal in place between the transom housing and the outer clamp bracket.

In non-limiting examples, a transom bracket assembly is for mounting a stern drive to a marine vessel. The transom bracket assembly comprises a transom housing configured for positioning in an opening in the transom, the transom housing comprising an outer end for coupling to a drive unit of the stern drive and an inner end for coupling to a powerhead of the stern drive; an outer clamp bracket configured for attachment to an outside surface of the transom and an inner clamp bracket configured for attachment to an inside surface of the transom; an outer vibration dampener configured to vibrationally isolate the drive unit and the powerhead relative to the outer clamp bracket; and an inner vibration dampener which is separate from the outer vibration dampener and which is configured to vibrationally isolate the drive unit and the powerhead relative to the inner clamp bracket.

Optionally, the outer vibration dampener may comprise a seal configured to prevent water intrusion to the marine vessel between the transom housing and the outer clamp bracket. Optionally, the seal may comprise a monolithic dual O-ring. Optionally, the transom bracket assembly may comprise a clamp plate which clamps the seal in place between the transom housing and the outer clamp bracket. Optionally, the inner vibration dampener may comprise a mount having an outer shell, a mounting hardpoint concentrically disposed in the outer shell, and an elastomeric spacer between the outer shell and the mounting hardpoint. Optionally, the inner vibration dampener may have a cylindrical shape.

BRIEF DESCRIPTION OF THE DRAWINGS

The present disclosure includes the following figures.

DETAILED DESCRIPTION

FIGS. 1-7 illustrate a stern drive 12 for propelling a marine vessel in a body of water. In the illustrated embodiments, the stern drive 12 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO.

Figure 1:
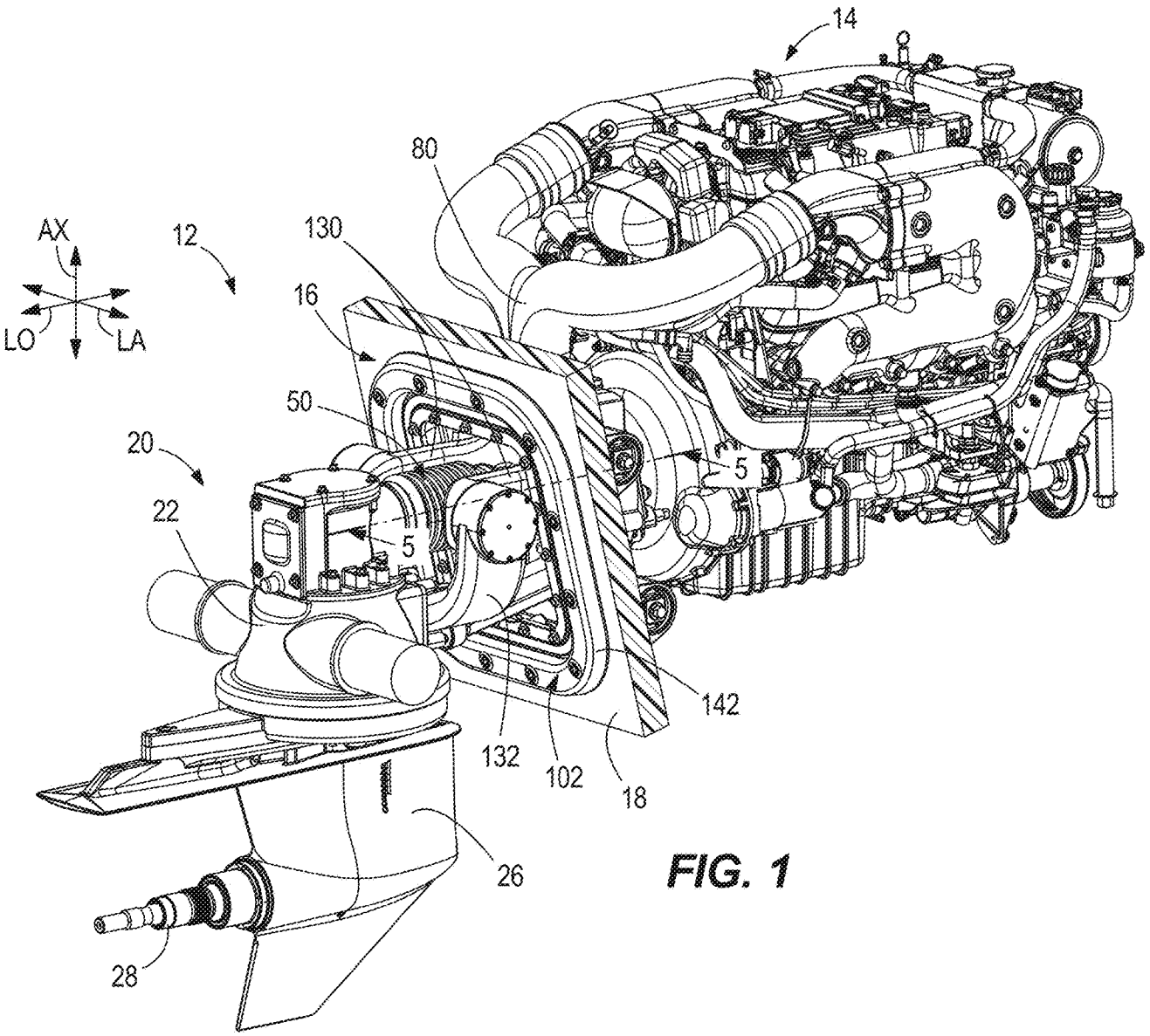
FIG. 1 is a starboard side perspective view of a stern drive with a transom bracket assembly.
Figure 2:
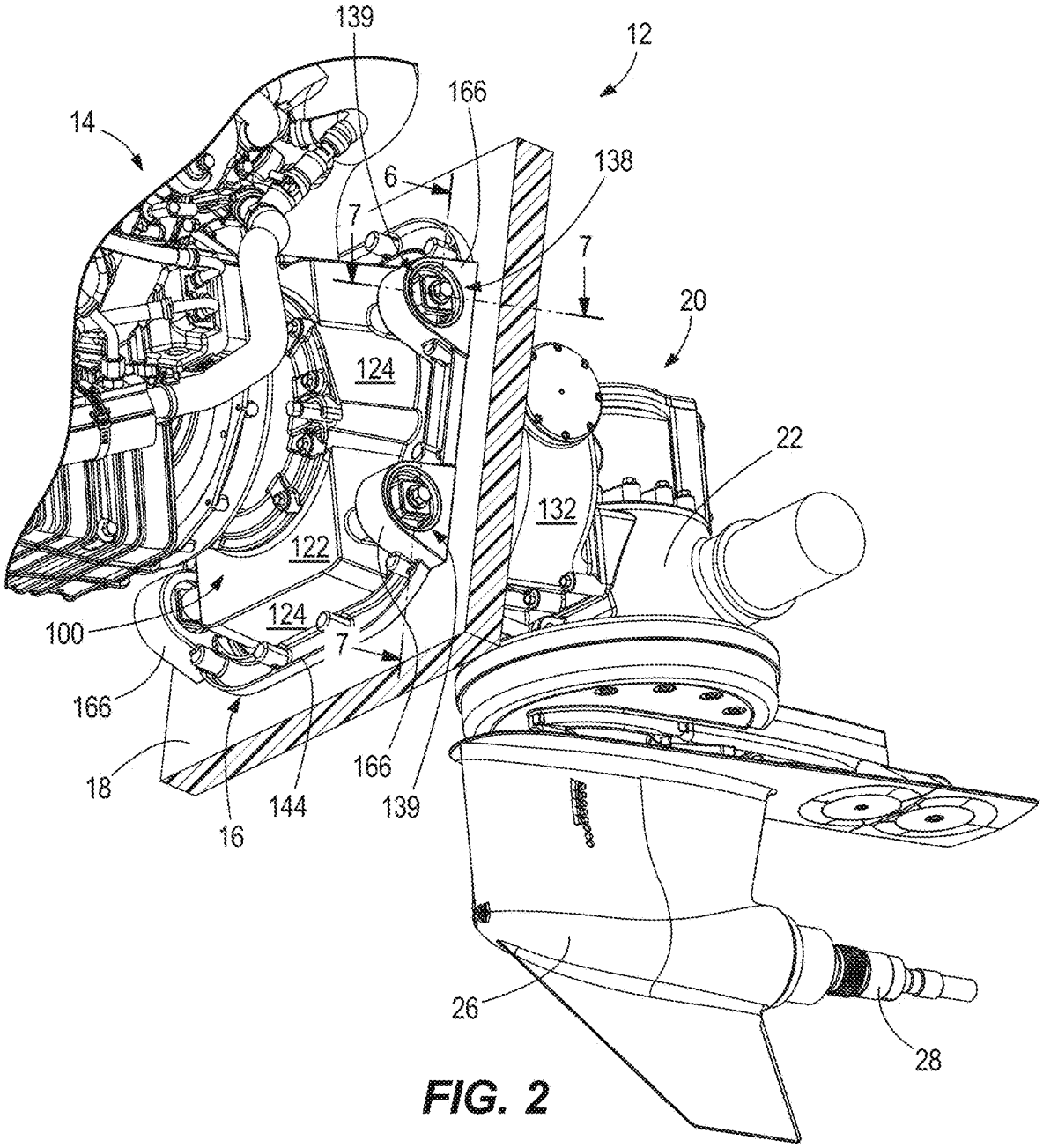
FIG. 2 is a port side perspective view of the stern drive and the transom bracket assembly of FIG. 1.

Referring to FIGS. 1 and 2, the stern drive 12 has a powerhead 14, a transom bracket assembly 16 which affixes and in some embodiments partially suspends the aft portion of the powerhead 14 from the transom 18 of the marine vessel, and a drive unit 20 coupled to the transom bracket assembly 16. The illustrated powerhead is not limiting and in other examples the powerhead may include an engine and/or a combination of an engine and an electric motor, and/or any other suitable means for powering a marine drive. The transom bracket assembly 16 is configured so that the powerhead 14 is in some embodiments partially suspended (i.e., cantilevered) from the interior of the transom 18, above the hull of the marine vessel. The drive unit 20 has a driveshaft housing 22 containing a driveshaft (not shown) and a gearcase housing 26 supported by the driveshaft housing 22 and containing one or more output shaft(s) 28, e.g., one or more propulsor shaft(s). The output shaft(s) 28 extends from the rear of the gearcase housing 26 and support one or more propulsors(s) (not shown) configured to generate thrust in the water for propelling the marine vessel. A universal joint 50 couples the powerhead 14 to the driveshaft so that operation of the powerhead 14 causes rotation of the driveshaft, which in turn causes rotation of the output shaft(s) 28.

Figure 3:
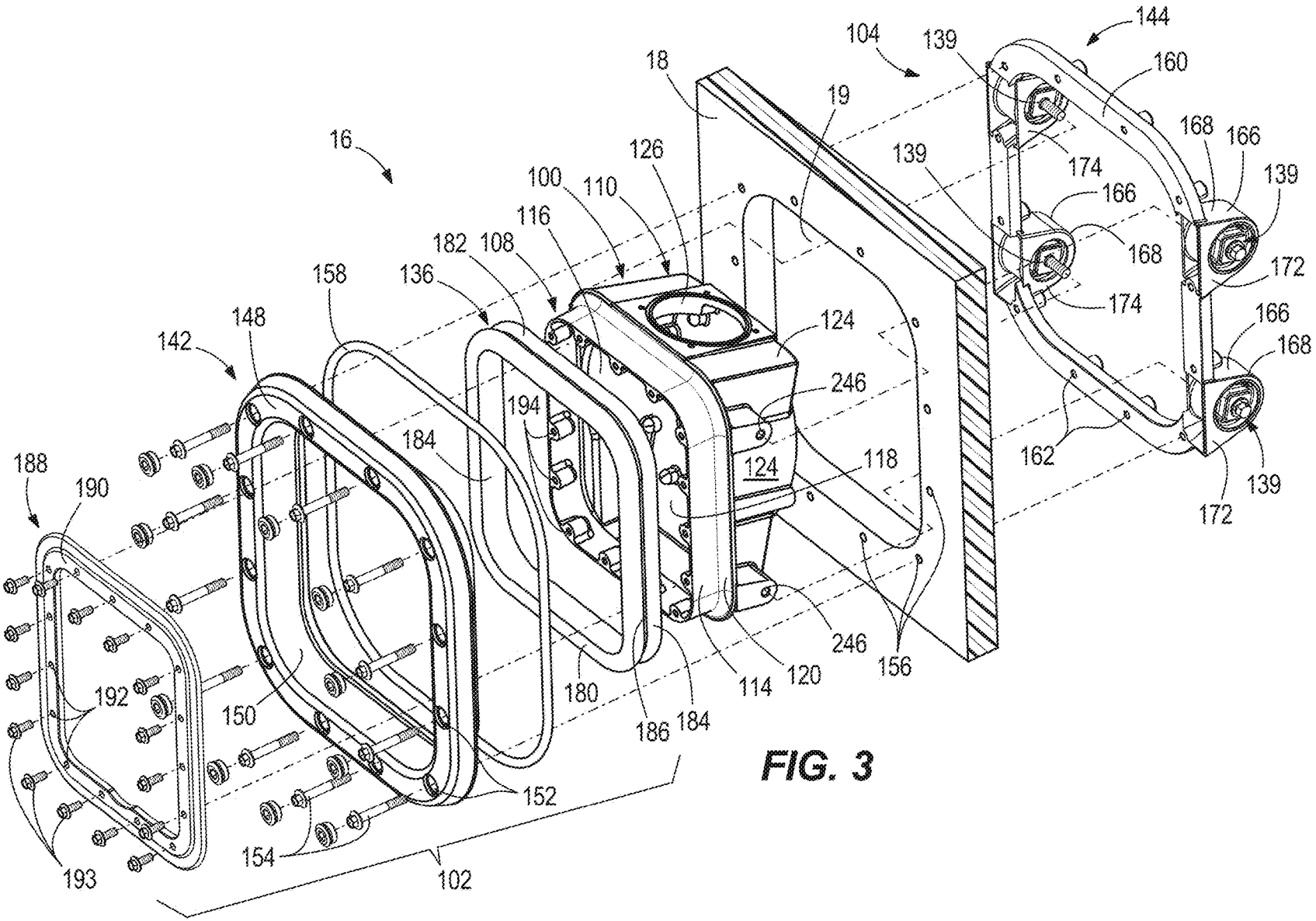
FIG. 3 is an exploded perspective view of the transom bracket assembly of FIG. 2.

Referring to FIGS. 1-3, some embodiments of a marine drive may be configured with a mounting assembly configured to vibrationally isolate the drive unit and/or the powerhead from the transom of the marine vessel. In the illustrated embodiments, for example, the stern drive 12 includes a transom bracket assembly 16 that is configured to suspend the drive unit 20 outside of the transom 18 and the powerhead 14 inside of the transom 18. The illustrated transom bracket assembly 16 includes an outer vibration dampener 136 (see FIG. 3) and an inner vibration dampener 138 (see FIG. 4) configured to vibrationally isolate the drive unit 20 and the powerhead 14 relative to the transom 18.

The transom bracket assembly 16 resides in (and extends through) an opening 19 in the transom 18 of the marine vessel and generally includes a transom housing 100, an outer portion 102 facing outside the marine vessel, and an inner portion 104 facing inside the marine vessel. The transom housing 100 is configured to be positioned in the opening 19 in the transom 18 and includes an outer end 108 configured for coupling to the drive unit 20 of the stern drive 12 and an inner end 110 configured for coupling to the powerhead 14 of the stern drive 12.

Referring to FIG. 3, the outer end 108 of the transom housing 100 includes an annular lip 114 that defines a rear opening 116 into an interior space 118 of the transom housing 100 and a flange 120 formed around the exterior of the annular lip 114. The inner end of the transom housing 100 includes a front wall 122 (FIGS. 5 and 7) and four side walls 124 that extend longitudinally from the annular lip 114 to the front wall 122. An exhaust opening 126 (FIG. 3) formed through the upper side wall 124 is configured to allow an exhaust conduit 80 (FIG. 1) to extend through the top side of the transom housing 100. A shaft opening 128 (FIG. 5) formed through the front wall 122 of the transom housing 100 is configured so that a shaft 82 operatively connecting the powerhead 14 to the universal joint 50 extends through the transom housing 100 between the interior side and exterior side of the transom 18. A pair of rigid mounting arms 130 (FIG. 1) extend rearwardly from the transom housing 100 and are pivotably coupled to a rigid, U-shaped mounting bracket 132 (FIG. 1) extending from the driveshaft housing 22. The pivot joint between the rigid mounting arms 130 and mounting bracket 132 defines a trim axis (not shown) about which the drive unit 20 is pivotable (i.e., trimmable), up and down relative to the transom bracket assembly 16. The transom housing 100 also supports the powerhead 14, the aft portion of which is partially suspended from a front side of the front wall 122 on the interior of the transom 18.

Referring to FIG. 3, the transom housing 100 is supported in the opening 19 of the transom 18 by the outer portion 102 of the transom bracket assembly 16, which includes an outer clamp bracket 142 configured for attachment to an outside surface of the transom 18, and the inner portion 104 of the transom bracket assembly 16, which includes an inner clamp bracket 144 configured for attachment to an inside surface of the transom 18.

The outer clamp bracket 142 includes an annular rim 148 that extends around the perimeter of the opening 19 on the exterior of the transom 18 and abuts the outer surface of the transom 18. An O-ring 158 may be positioned between the annular rim 148 of the outer clamp bracket 142 and the transom 18 to form a seal therebetween. Other embodiments, however, may omit an O-ring. A support surface 150 of the outer clamp bracket 142 extends in the forward longitudinal direction from the annular rim 148 into the opening 19 along the periphery of the opening 19. Mounting holes 152 formed through the surface of the annular rim 148 are configured to receive fasteners 154 that extend through through-bores 156 formed in the transom 18. As will be discussed in further detail below in reference to FIGS. 5 and 7, the outer clamp bracket 142 may include a locating protrusion 151 and/or other positioning features that are configured to engage the outer vibration dampener 136 in order to retain the outer vibration dampener 136 and/or the transom housing 100 in a desired position.

Figure 4:
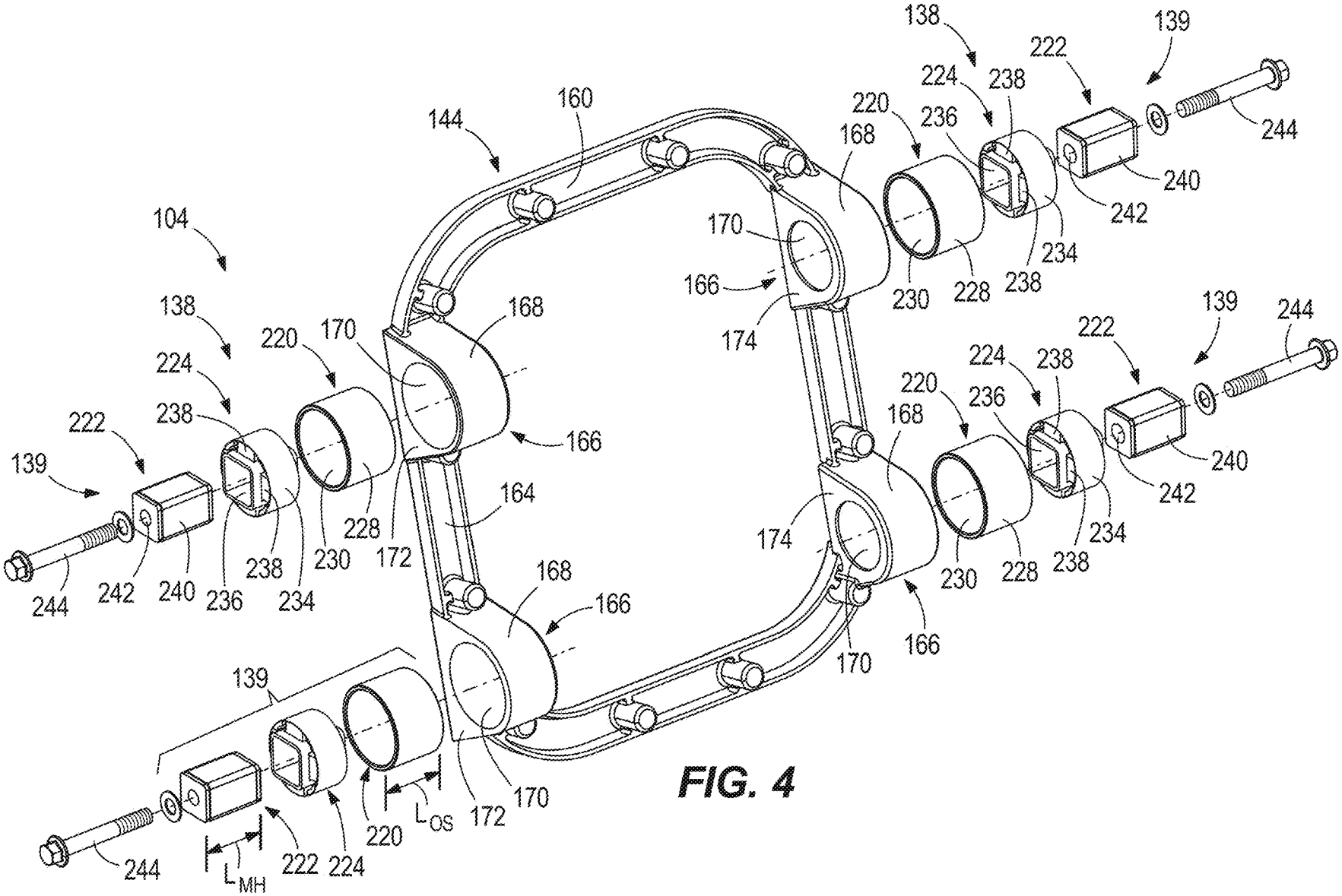
FIG. 4 is an exploded perspective view of the inner portion of the transom bracket assembly of FIG. 3.

Referring to FIGS. 3 and 4, the inner clamp bracket 144 includes an annular rim 160 that extends around the opening 19 on the interior of the transom 18 and abuts the interior surface of the transom 18. Mounting holes 162 (see FIG. 3) formed around the annular rim 160 correspond to, and are positioned in alignment with, the through-bores 156 in the transom 18 and the mounting holes 152 in the outer clamp bracket 142. The mounting holes 162 are configured to be engaged by the fasteners 154 that extend through the outer clamp bracket 142 and the through-bores 156, thereby clamping the inner clamp bracket 144 and the outer clamp bracket 142 together on the transom 18 and coupling the inner and outer clamp brackets 142, 144 to the transom 18.

To support the inner vibration dampener 138 on the transom bracket assembly 16, some embodiments of an inner clamp bracket 144 may be configured with a dampener mounting arrangement. For example, referring to FIG. 4, the illustrated inner clamp bracket 144 includes four dampener mounting brackets 166 positioned on the annular rim 160. Two of the illustrated dampener mounting brackets 166 are configured as upper and lower port side dampener mounting brackets 166, and the other dampener mounting brackets 166 are configured as upper and lower starboard side dampener mounting brackets 166. Each dampener mounting bracket 166 includes a bracket body 168 that is positioned on a front-facing side 164 (FIG. 4) of the annular rim 160 and extends in a forward longitudinal direction from the front-facing side 164. A counter bore 170 extends laterally through the bracket body 168 from an outward-facing surface 172 to an inward-facing surface 174 of the bracket body 168. At the inward-facing surface 174 of each dampener mounting bracket 166, an annular lip 176 is formed around the radially inner sidewalls of the counter bore 170 such that the opening into the counter bore 170 on the outward-facing surface 172 has a larger diameter than the opening on the inward-facing surface 174. As is explained in greater detail below, the counter bore 170 of each dampener mounting bracket 166 is configured to receive a vibration dampening mount 139 that supports the transom housing 100 on the inner clamp bracket 144.

In the illustrated embodiments, the upper and lower port side dampener mounting brackets 166 are respectively aligned with the upper and lower starboard side dampener mounting brackets 166 such that their through-bores 170 are concentrically aligned. Some embodiments, however, may include at least one dampener mounting brackets that is not in alignment with another dampener mounting brackets. Additionally, or alternatively, an inner clamp bracket 144 may include more than four or fewer than four dampener mounting brackets, and at least one of the dampener mounting brackets may have a different shape, size, and/or position than those of the illustrated embodiments.

Figure 5:
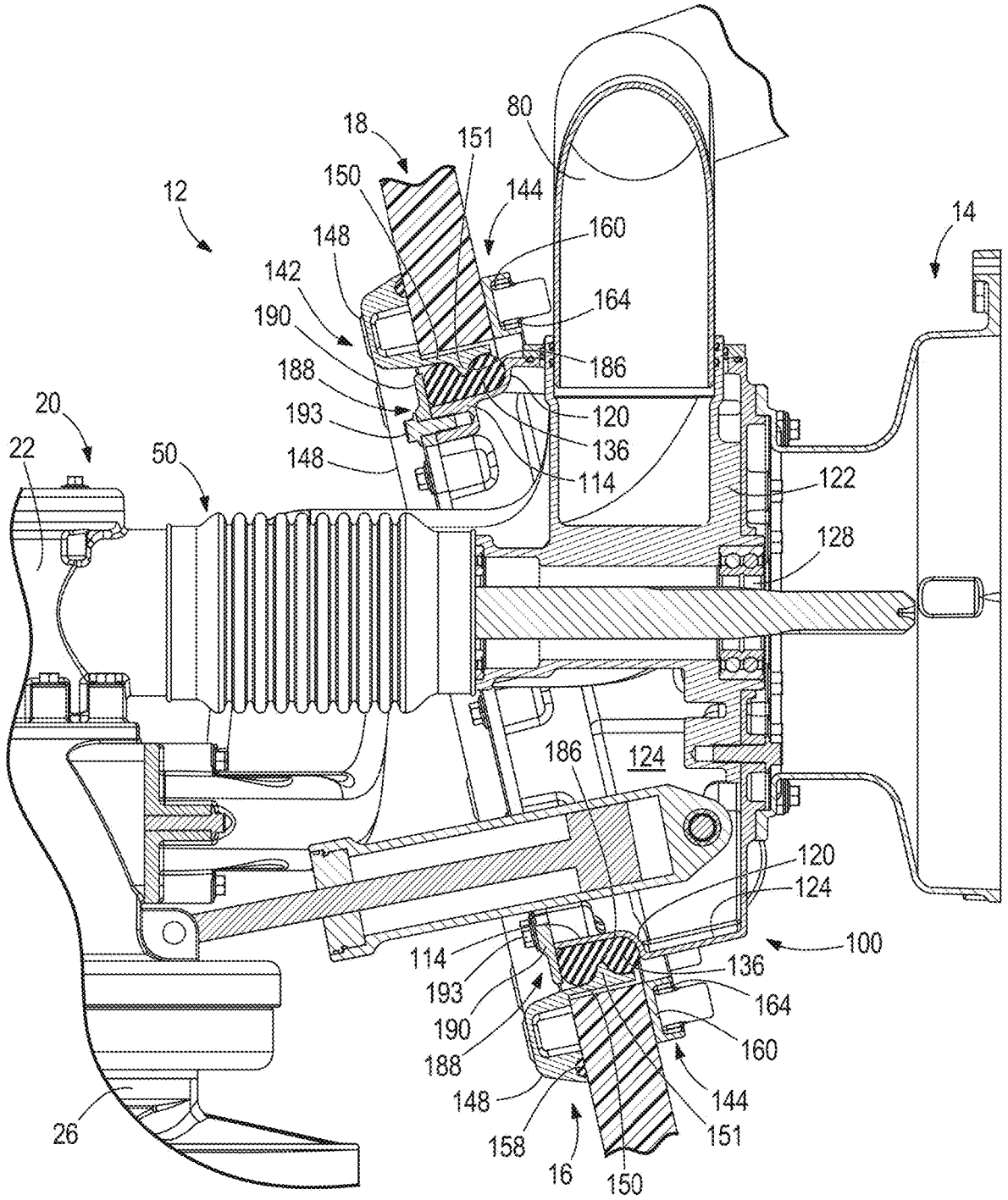
FIG. 5 is a view of section 5-5, taken in FIG. 1.
Figure 7:
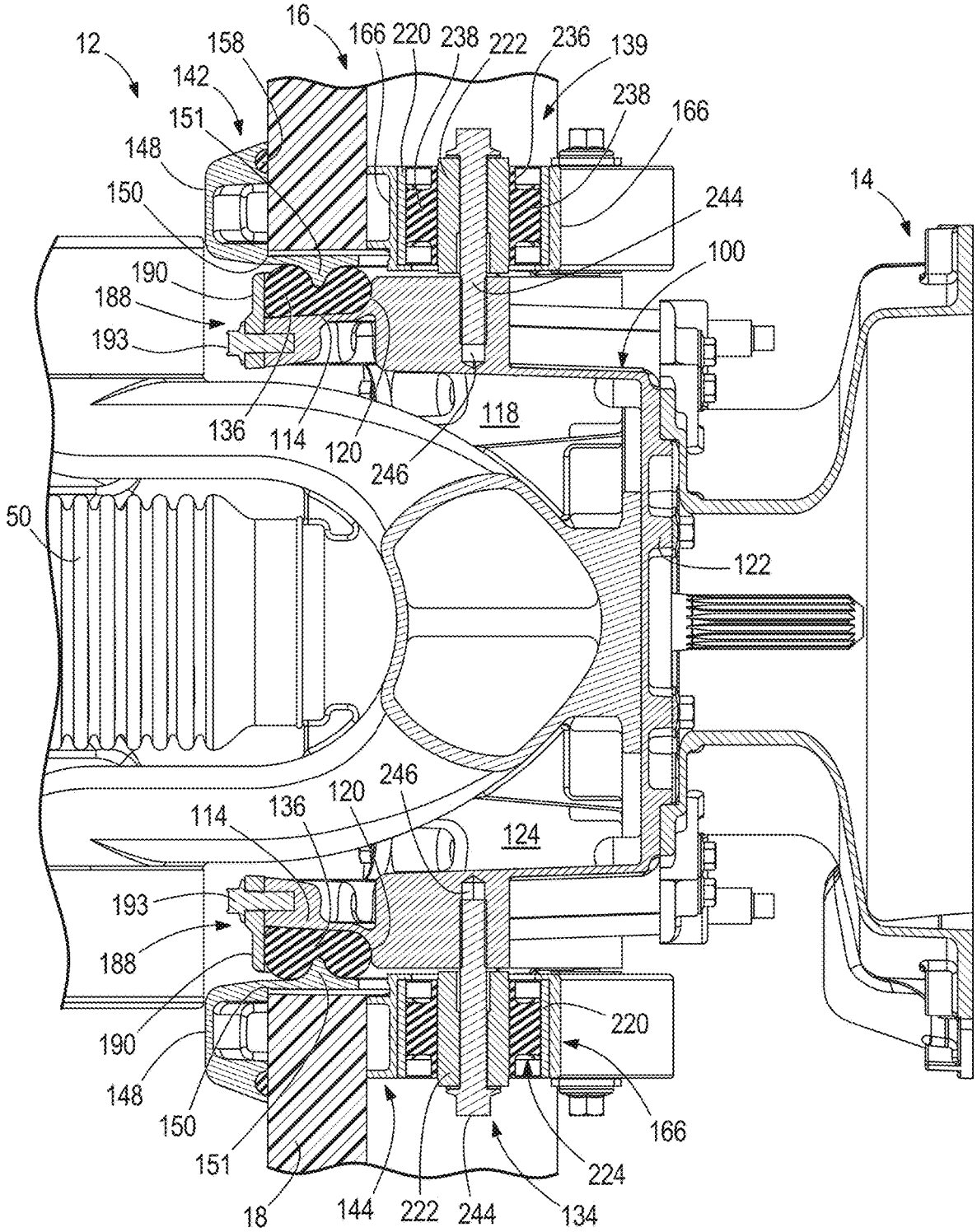
FIG. 7 is a view of section 7-7, taken in FIG. 2.

As previously mentioned, the transom bracket assembly 16 may include an outer vibration dampener 136 which supports the drive unit 20 and the powerhead 14 on the outer clamp bracket 142 and vibrationally isolates the drive unit 20 and the powerhead 14 relative to the outer clamp bracket 142. Referring to FIGS. 3, 5, and 7, the illustrated outer vibration dampener 136 is a seal configured as a monolithic dual O-ring that is sandwiched between the support surface 150 of the outer clamp bracket 142 and the annular lip 114 of the transom housing 100. The outer vibration dampener 136 forms a seal between the transom housing 100 and the outer clamp bracket 142 to prevent water intrusion to the marine vessel between the transom housing 100 and the outer clamp bracket 142.

As illustrated in FIG. 3, the illustrated outer vibration dampener 136 has a horizontal lower segment 180, a horizontal upper segment 182, and opposing vertical side segments 184 that extend between the upper segment 182 and the lower segment 180 proximate the lateral sides thereof. The outer vibration dampener 136 may be formed from a vibration dampening material (e.g., rubber or other pliable and/or resiliently deformable material) and has a cross sectional profile that is consistent around the body of the outer vibration dampener 136.

In some embodiments, an outer vibration dampener 136 may be configured with at least one segment 180, 182, 184 that is differently shaped and/or sized than the segments 180, 182, 184 of the illustrated outer vibration dampener 136. For example, at least one of the segments 180, 182, 184 of the outer vibration dampener 136 may have a different cross-sectional profile than at least one of the other the segments 180, 182, 184. At least one segment 180, 182, 184 of the outer vibration dampener 136 may have a cross-sectional shape that changes along the length of the segment. Additionally, or alternatively, the material composition of the outer vibration dampener 136 may vary between different segments 180, 182, 184 and/or between different portions of a segment 180, 182, 184.

Referring to FIGS. 3, 5 and 7, a groove 186 is formed in an outward-facing surface of the outer vibration dampener 136 and extends around perimeter of the outer vibration dampener 136. As best illustrated in FIGS. 5 and 7, the groove 186 is configured to be engaged by the locating protrusion 151 formed on the support surface 150 of the outer clamp bracket 142. Engagement between the locating protrusion 151 and the groove 186 retains the outer vibration dampener 136 in position relative to the outer clamp bracket 142. The transom housing 100 is supported on the outer clamp bracket 142 by the outer vibration dampener 136. To secure the transom housing 100 to the outer vibration dampener 136, the outer portion 102 of the transom bracket assembly 16 includes a clamp plate 188. The clamp plate 188 configured to clamp the outer vibration dampener 136 in place between the clamp plate 188 and the flange 120 of the transom housing 100. Referring to FIG. 3, the clamp plate 188 includes a generally planar annular rim 190 with a plurality of holes 192 formed longitudinally through the annular rim 190. The holes 192 are configured to receive fasteners 193 that extend through the holes 192 in the clamp plate 188 to engage a set of corresponding holes 194 formed around the annular lip 114 of the transom housing 100 to secure the clamp plate 188 to the transom housing 100. As illustrated in FIGS. 5 and 7, when the clamp plate 188 is installed, the outer vibration dampener 136 is clamped between the clamp plate 188 and the flange 120 of the transom housing 100, thereby retaining the transom housing 100 in position relative to the outer clamp bracket 142 and suspending the transom housing 100 therefrom. This may be useful, for example, so that vibrations produced by the powerhead 14 and drive unit 20 are transferred to the outer vibration dampener 136 before reaching the outer clamp bracket 142 and the transom 18.

As previously mentioned, the transom bracket assembly 16 includes an inner vibration dampener 138 which is separate from the outer vibration dampener 136 and vibrationally isolates the drive unit 20 and the powerhead 14 relative to the inner clamp bracket 144. Referring to FIGS. 3 and 4, the illustrated inner vibration dampener 138 includes four vibration dampening mounts 139 that are generally cylindrical and are each positioned in a corresponding one of the dampener mounting brackets 166 on the inner clamp bracket 144.

Referring to FIG. 4, each vibration dampening mount 139 includes an outer shell 220, a mounting hardpoint 222 concentrically disposed in the outer shell 220, and an elastomeric spacer 224 between the outer shell 220 and the mounting hardpoint 222. The outer shell 220 has a hollow, generally cylindrical body 228 with a through-bore 230 extending between opposing ends of the body 228. The cylindrical body 228 has a length Los and is dimensioned so that the outer shell 220 is slidably received in one of the dampener mounting brackets 166 such that a radially outer surface of the body 228 abuts the radially inner surface of the counter bore 170 formed through the vibration dampening mount 139.

The mounting hardpoint 222 has a rigid body 240 with a through-bore 242 extending between opposing sides of the rigid body 240. In the illustrated embodiments, the body 240 is generally rectangular and has a length LMH that is longer than the length Los of the outer shell 220. Other embodiments, however, may be configured with at least one differently shaped mounting hardpoint 222. The elastomeric spacer 224 is configured to support the mounting hardpoint 222 within the outer shell 220 and includes a cylindrical perimeter wall 234, a hardpoint support 236 positioned concentrically within the perimeter wall 234, and at least one support member 238 extending radially between the hardpoint support 236 and the radially inner surface of the perimeter wall 234. In the illustrated embodiment, the hardpoint supports 236 are generally rectangular to correspond to the shape of the bodies 240 of the mounting hardpoints 222. One support member extends between the perimeter wall 234 and each side of the rectangular hardpoint support 236 such that there are four hardpoint supports 238 spaced around the hardpoint support 236.

In embodiments that have a differently shaped mounting hardpoint 222, the corresponding hardpoint support 236 may be shaped to match the outer profile of said mounting hardpoint 222. Additionally, or alternatively, an elastomeric spacer 224 may be configured with a different number of support members 238 extending between the perimeter wall 234 the hardpoint support 236. Further still, some embodiments may include a single, solid or substantially solid support member that formed around the hardpoint support 236 and extending radially outward to the perimeter wall 234.

Figure 6:
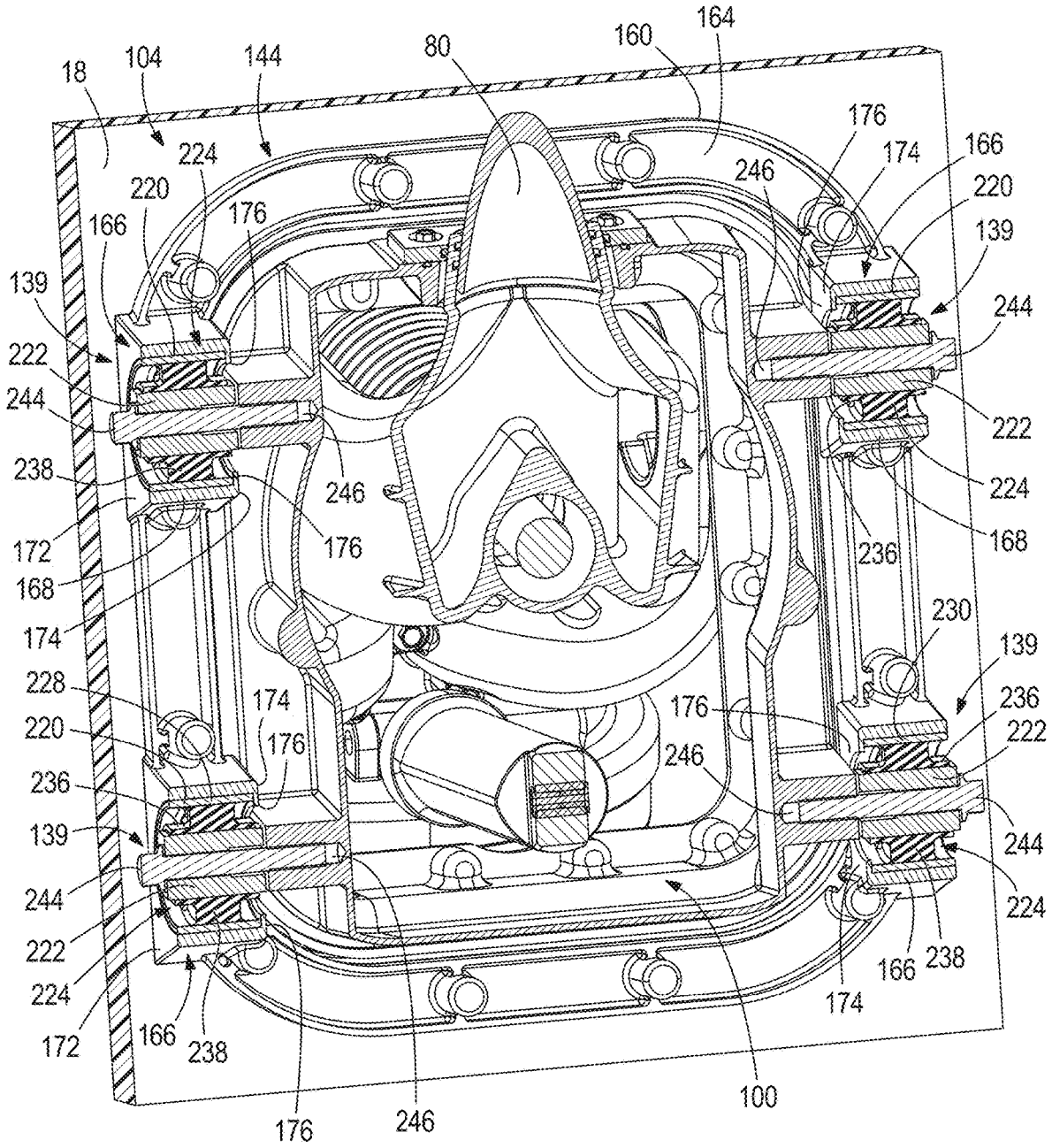
FIG. 6 is a perspective view of section 6-6, taken in FIG. 2.

Each vibration dampening mount 139 may be assembled by positioning a mounting hardpoint 222 in the hardpoint support 236 of an elastomeric spacer 224 and positioning the elastomeric spacer 224 within the through-bore 230 of an outer shell 220. Referring to FIGS. 6 and 7, when the vibration dampening mounts 139 are positioned in the dampener mounting brackets 166, a fastener 244 extends through the through-bore 242 in the mounting hardpoint 222 to engage a corresponding mounting opening 246 (FIG. 3) formed in the side of the transom housing 100, thereby securing the transom housing 100 to the vibration dampening mounts 139 such that the transom housing 100 is supported on the inner clamp bracket 144 by the inner vibration dampener 138. As illustrated in FIGS. 5 and 6, an axial end of each outer shell 220 abuts the annular lip 176 at the inward-facing surface 174 of the corresponding vibration dampening mount 139, thereby restricting inward lateral movement of the vibration dampening mounts 139 towards the middle of the inner clamp bracket 144. Since the length LMH of the mounting hardpoints 222 is greater than the length Los of the outer shells 220, the ends of the mounting hardpoints 222 extend past the outward-facing and inward-facing surfaces 172, 174 of the vibration dampening mounts 139 so that the transom housing 100 is spaced apart from, and does not make contact with, the inner clamp bracket 144. Thus, the transom housing 100 is suspended from the inner clamp bracket 144 by the vibration dampening mounts 139 of the inner vibration dampener 138. This may be useful, for example, so that vibrations produced by the powerhead 14 and drive unit 20 are transferred to the vibration dampening mounts 139 of the inner vibration dampener 138 before reaching the inner clamp bracket 144 and the transom 18.

The novel transom bracket assembly 16 may be at least partially preassembled prior to installation on the transom 18 of a marine vessel. This may be useful, for example, so that the stern drive 12 can be easily and efficiently installed in a marine vessel. In some embodiments, the outer portion 102 and the inner portion 104 of the transom bracket assembly 16 may be preassembled before installation so that they may be secured to the transom 18 from the exterior of the marine vessel's hull.

The inner portion 104 may be preassembled by inserting the vibration dampening mounts 139 into the corresponding dampener mounting bracket 166 on the inner clamp bracket 144. The outer portion 102 of the transom bracket assembly 16 may be preassembled by positioning the outer vibration dampener 136 on the support surface 150 of the outer clamp bracket 142 such that the locating protrusion 151 is received in the groove 186 formed in the outer vibration dampener 136. The transom housing 100 may then be secured to the outer clamp bracket 142 by sliding the annular lip 114 of the transom housing 100 into the outer clamp bracket 142 such that an inward facing surface of the outer vibration dampener 136 abuts the annular lip 114. The clamp plate 188 is then inserted into the outer clamp bracket 142 and coupled to the transom housing 100 using the fasteners 193, and the O-ring 158 is moved into position around the outer clamp bracket 142. Additionally, or alternatively, the preassembled outer portion 102 may include the drive unit 20 secured to the transom housing 100 such that the drive unit 20 is secured to the marine vessel with the outer portion 102 of the transom bracket assembly 16. In some embodiments, however, the drive unit 20 may be secured to the transom housing 100 after the transom bracket assembly 16 is installed on the marine vessel.

Once the inner and outer portion 102, 104 have been preassembled, they may be secured to the transom 18 from the exterior of the marine vessel's hull. The assembled inner portion 104 may passed through the opening 19 in the transom 18 by rotating the inner clamp bracket 144 to fit diagonally through the opening 19. Once on the interior of the hull, the inner clamp bracket 144 may be moved into position against the inner surface of the transom 18 such that the annular rim 160 of the inner clamp bracket 144 extends around the opening. In some embodiments, lag screws may be used to temporarily hold the inner clamp bracket 144 in position prior to attachment of the outer portion 102.

The outer portion 102 of the transom bracket assembly 16 may thus be positioned in on the transom 18 by inserting the front end of the transom housing 100 through the opening such that the annular rim 148 of the outer clamp bracket 142 is pressed against an outer surface of the transom 18, thereby sandwiching the O-ring 158 between the annular rim 148 of the outer clamp bracket 142 and the outer surface of the transom 18. fasteners 154 may then be inserted through the mounting holes 152 in the outer clamp and the through-bore 156 in the transom 18 to engage the mounting holes 162 in the inner clam bracket 144, thereby coupling the transom bracket assembly to the transom 18. Fasteners 242 may then be used to couple the vibration dampening mounts 139 to the transom housing 100 so that the transom housing is supported on the inner vibration dampener 138. The powerhead 14 and the drive unit 20 (if not preassembled) may be secured to the transom bracket assembly 16 to assemble the stern drive 12.

Once the stern drive 12 is secured to the transom 18, the drive unit 20 and the powerhead 14 are suspended from the transom 18 by the outer vibration dampener 136 and the inner vibration dampener 138 (i.e., the vibration dampening mounts 139), there by vibrationally isolating the stern drive 12 from the hull of the marine vessel. The outer vibration dampener 136 isolates vibrations from the drive unit 20 to limit the transfer of the vibrations to the hull. The inner vibration dampener 138 suspend the aft portion of the powerhead 14 from the inside of the transom 18 above the bottom of the hull, further limiting vibrations transferred to the boat hull. Thus, all vibrations emanating from the stern drive must travel through the inner and/or outer vibration dampeners 136, 138 to reach the hull of the marine vessel.

In some embodiments, the outer vibration dampener 136 may be secured to the outer clamp bracket 142 and/or the transom housing 100 via an adhesive or bonding agent. For example, the outer vibration dampener 136 may be bonded to the annular lip 114 of the transom housing 100 and/or the support surface 150 of the outer clamp bracket 142 with an adhesive prior to installation of the stern drive 12 on the transom 18. By bonding the outer vibration dampener 136 to the transom housing 100 and/or the outer clamp bracket 142 prior to installation, the outer vibration dampener 136 is secured thereto in a relaxed configuration. This may be useful, for example, to provide enhanced control over (i.e., tuning of) the spring rate of the outer vibration dampener 136, and to better prevent a leak path from forming around the outer vibration dampener 136. In some embodiments, at least one of the material(s) of the outer vibration dampener 136, the shape of the outer vibration dampener 136, and/or the dimensions of the outer vibration dampener 136 may be selected based on the desired spring rate of the outer vibration dampener 136 and/or any other desired parameter thereof.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples which occur to those skilled in the art. Such other examples are intended to be within the scope of the claims if they have features or structural elements which do not differ from the literal language of the claims, or if they include equivalent features or structural elements with insubstantial differences from the literal languages of the claims.

The invention claimed is:

1. A transom bracket assembly for mounting a stern drive to a transom of a marine vessel, the transom bracket assembly comprising:

an inner clamp bracket and an outer clamp bracket that are configured to clamp on opposite sides of the transom, a transom housing that is supported by the inner clamp bracket and outer clamp bracket and configured to support a drive unit of the stern drive outside of the marine vessel and a powerhead of the stern drive inside of the marine vessel, a vibrational dampener that elastically supports the transom housing between the inner clamp bracket and the outer clamp bracket, and a plurality of elastomeric mounts that elastically suspends the transom housing from the inner clamp bracket.

2. The transom bracket assembly according to claim 1, wherein the vibrational dampener is positioned between the inner clamp bracket and the outer clamp bracket and wherein the plurality of elastomeric mounts is on the inner clamp bracket.

3. The transom bracket assembly according to claim 1, wherein the plurality of elastomeric mounts is spaced apart on the inner clamp bracket.

4. The transom bracket assembly according to claim 1, wherein the plurality of elastic mounts comprises at least two elastomeric mounts that are located on a port side of the inner clamp bracket and at least two elastomeric mounts that are located on a starboard side of the inner clamp bracket.

5. The transom bracket assembly according to claim 4, wherein the at least two elastomeric mounts that are located on the port side of the inner clamp bracket are aligned with the at least two elastomeric mounts that are located on the starboard side of the inner clamp bracket.

6. The transom bracket assembly according to claim 1, wherein each of the plurality of elastomeric mounts comprises an outer shell and an elastomeric spacer.

7. The transom bracket assembly according to claim 6, wherein each of the plurality of elastomeric mounts comprises a fastener that extends through the elastomeric spacer and fastens the inner clamp bracket to the transom housing.

8. The transom bracket assembly according to claim 7, wherein each of the plurality of elastomeric mounts comprises a mounting hard point through which the fastener extends.

9. The transom bracket assembly according to claim 6, wherein the elastomeric spacer is cylindrical.

10. The transom bracket assembly according to claim 1, wherein the vibrational dampener is sandwiched between the transom housing and at least one of the inner clamp bracket and the outer clamp bracket.

11. The transom bracket assembly according to claim 1, wherein the vibrational dampener provides a seal configured to prevent water intrusion into the marine vessel.

12. The transom bracket assembly according to claim 1, wherein the vibrational dampener includes an annular seal configured to prevent water intrusion into the marine vessel.

13. The transom bracket assembly according to claim 12, wherein the annular seal comprises a groove that extends along a perimeter of the annular seal and is mated with a locating protrusion on at least one of the inner clamp bracket and the outer clamp bracket.

14. The transom bracket assembly according to claim 1, wherein the vibrational dampener comprises an annular monolithic dual O-ring seal.

15. The transom bracket assembly according to claim 1, wherein the vibrational dampener comprises an annular member having a cross-section that varies along a length of the annular member.

16. The transom bracket assembly according to claim 1, wherein the vibrational dampener is adhered to the transom bracket assembly.

17. A transom bracket assembly for mounting a stern drive to a transom of a marine vessel, the transom bracket assembly comprising:

an inner clamp bracket and an outer clamp bracket that are configured to clamp on opposite sides of the transom, a transom housing for positioning in an opening through the transom, the transom housing configured to support a drive unit of the stern drive outside the marine vessel and a powerhead of the stern drive inside the marine vessel, an outer vibrational dampener that elastically supports the transom housing in the opening relative to the inner clamp bracket and the outer clamp bracket, and an inner vibrational dampener that elastically suspends the transom housing from the inner clamp bracket, wherein the inner vibrational dampener comprises a plurality of elastomeric mounts that is spaced apart on the inner clamp bracket.

* * * * *